US006257989B1

(12) United States Patent
Tortola et al.

(10) Patent No.: US 6,257,989 B1
(45) Date of Patent: Jul. 10, 2001

(54) METHOD AND APPARATUS FOR ESTIMATING PRACTICE GOLF SHOT DISTANCE AND ACCURACY

(75) Inventors: Angelo Tortola, Lexington, MA (US); James J. Dennesen, Hampstead, NH (US)

(73) Assignee: Dennco, Inc., Salem, NH (US)

( * ) Notice: Subject to any disclaimer, the term of this patent is extended or adjusted under 35 U.S.C. 154(b) by 0 days.

(21) Appl. No.: 09/305,385

(22) Filed: May 5, 1999

Related U.S. Application Data

(60) Provisional application No. 60/084,306, filed on May 5, 1998.

(51) Int. Cl.[7] ..... A63B 69/36

(52) U.S. Cl. ..... 473/140; 473/146

(58) Field of Search ..... 473/139, 140, 473/143, 145, 147, 146, 138

(56) References Cited

U.S. PATENT DOCUMENTS

| | | | |
|---|---|---|---|
| 1,471,794 | 10/1923 | Leven . | |
| 1,529,305 | 3/1925 | Gatke . | |
| 2,005,915 | 6/1935 | Grelle . | |
| 2,223,647 | 12/1940 | Stumpf . | |
| 2,497,237 | 2/1950 | Reineking . | |
| 3,033,575 | 5/1962 | Hause . | |
| 3,229,980 | 1/1966 | Silberman . | |
| 3,406,571 | 10/1968 | Hackey . | |
| 3,606,340 | 9/1971 | Tiller . | |
| 3,738,660 | 6/1973 | Branz et al. . | |
| 3,815,922 | 6/1974 | Brainard | 273/184 B |
| 4,014,552 | 3/1977 | Watson | 273/185 C |
| 4,118,033 | 10/1978 | Miyamoto | 273/186 A |
| 4,254,956 | 3/1981 | Rusnak | 273/186 R |
| 4,429,880 | 2/1984 | Chen et al. | 273/176 FA |
| 4,479,653 | 10/1984 | Woodson | 273/183 B |
| 4,630,829 | 12/1986 | White | 273/186 A |
| 4,660,835 | 4/1987 | Locurto | 273/58 C X |
| 4,844,469 | 7/1989 | Yasuda et al. | 273/186 R |
| 4,854,585 | 8/1989 | Koch et al. | 273/193 B |
| 4,971,326 | 11/1990 | Montone | 273/185 C |
| 5,035,432 | 7/1991 | Lew | 273/176 FA |
| 5,121,923 * | 6/1992 | D'Allura | 473/140 |
| 5,178,393 * | 1/1993 | Dennesen | 473/140 |
| 5,255,920 * | 10/1993 | Mangeri | 473/140 |
| 5,454,561 * | 10/1995 | Smith | 473/140 |
| 5,997,405 * | 12/1999 | Russell et al. | 473/140 |

FOREIGN PATENT DOCUMENTS 2150841 7/1985 (GB) .

* cited by examiner

*Primary Examiner*—Kien T. Nguyen
(74) *Attorney, Agent, or Firm*—Sam Pasternack, Esq.; Brenda H. Jarrell, Esq.; Choate, Hall & Stewart

(57) ABSTRACT

Disclosed is a method and apparatus for estimating practice golf shot deviation and distance. The apparatus includes a base, an axle mounted to the base, a golf ball attached to the axle and a sensor coupled to the axle for determining motion thereof. When the golf ball is struck by a golf club, the ball and axle attached thereto rotate around a pivot point provided by the base. When the ball is struck such that it deviates from a plane that is perpendicular to the axle, the sensor detects motion of the axle along its axis. The magnitude and direction of deviation is estimated based upon the detected motion of the axle along its axis. The distance that the ball would have traveled is estimated based upon the detected speed with which the axle rotates.

41 Claims, 12 Drawing Sheets

+5V
+5V
R25
10K
R14
10K
+5V
14
U12A
1
2
LAT_DIR
7
40106
C
U12B
3
4
LAT_CLK
40106
ROT_ LED
ROT_COLLECTOR
A
+5V
VCC
R23
100K
106
D8
1N4148
C15
0.1UF
FROM
FIG.
4A
TO
FIG.
4C
V_BATT
3
R15
100K
S
Q2
BSS110
2
G
POWER OFF
D
1
VCC
LOW=POWER ON
HIZ=POWER OFF
ROT DET
B
VCC
U10
78L05
+5V
VCC
3
IN
OUT
1
GND
3
C14
0.1UF
2

+5V
+5V
R20
300
R21
300
R22
300
R24
300
D4
LED,
RED
D5
LED,
RED
D6
LED,
RED
D7
LED,
RED
U9
RA2/AN2
RN3/AN3/Vref
RA4/TOCKI
*MCLR/VPP
VSS
RB0/INT
RB1
RB2
RB3
RA1/AN1
RA0/AN0
OSC1/CLKIN
OSC2/CLKOUT
VDD
RB7
RB6
RB5
RB4
/RESET
FROM
FIG.
4B
TO
FIG.
4D
ROT_ DET
16C554
102
+5V
U10
78L05
IN OUT
GND
C14
0.1UF +5V
R16
300
R17
300
R18
300
122
D1
LED,
RED
D2
LED,
RED
D3
LED,
RED
+5V
FROM
FIG.
4C
LAT_DIR
LAT_CLK
R26
10K
C17
*33pF
XI
4.00MHz
C18
*33pF
C
J4
1
2
CON2
SHORT PINS FOR TEST MODE
NOTE: CHECK INTERNAL PULLUP IN PIC
104

METHOD AND APPARATUS FOR ESTIMATING PRACTICE GOLF SHOT DISTANCE AND ACCURACY

REFERENCE TO RELATED APPLICATION

This application also claims the benefit of the filing date of U.S. Provisional Application Ser. No. 60/084,306 and filed May 5, 1998. The teachings of the provisional application are incorporated herein by reference.

BACKGROUND OF THE INVENTION

This invention relates to a method and apparatus for practicing golf shots within a very limited space. More particularly, the present invention relates to a method and apparatus for estimating both the length and the accuracy of a practice golf shot.

There are a number of devices and methods presently available for practicing a golf swing and golf shots in a small area. Such devices and methods include a plastic or foam-rubber ball that does not travel very far, or a net or other restraining method to keep the ball from traveling too far. Although these types of devices and methods provide some degree of golf practice there is very little feedback regarding the effectiveness of the shot, namely the distance and accuracy of same.

A partial solution to the feedback problem is provided in U.S. Pat. No. 5,178,393 to Dennesen incorporated herein in full by reference. This patent discloses a device that allows for practicing golf shots in a limited area and the device includes elements that provide an estimate of the distance that the shot would travel. The invention disclosed in the patent includes a golf ball tethered to a rotatable axle and circuitry for calculating the estimated length of the shot from the initial velocity of the ball. The device provides feedback, in the form of displaying the estimated length on a display, to a practicing golfer. Except to the extent that the practicing golfer visually observes deviation of the ball from what would be a straight and accurate shot, this device does not provide very much feedback regarding the accuracy of the shot.

A device disclosed in U.S. Pat. No. 5,255,920 to Mangeri provides both distance and deviation estimates, however, such device requires overly sensitive instrumentation including a flexible disk and multiple strain gauges precisely located on the disk. The disk is mounted on the outside of the device and directly contacts a rope that is attached to a golf ball. The disk and the multiple strain gauges are susceptible to wear and failure from such direct contact. The assembly is further susceptible to the environment because the disk and strain gauge assembly must be exposed in order to contact the rope.

It is therefore an object of the present invention to provide a method and apparatus for practicing golf shots in a limited area. It is another object of the present invention to provide a method and apparatus that provides feedback as to accuracy of the practiced shot. It is another object of the present invention to provide a method and apparatus that provides feedback as to both distance and accuracy of the practiced shot. It is yet another object of the present invention to provide such distance and accuracy feedback with simple and inexpensive parts and a durable design.

SUMMARY OF THE INVENTION

These and other objects of the invention are achieved with an apparatus that includes a base, an axle mounted to the base, a golf ball attached to the axle and a sensor coupled to the axle for determining motion thereof for estimating a distance and a direction of the golf ball based upon motion of the axle. When the golf ball is struck by a golf club, the ball and axle attached thereto rotate around a pivot point provided by the base. Within approximately ninety degrees of the first rotation of the golf ball, the sensor detects the angle of the plane in which the ball is moving around the pivot point based upon a lateral motion of the axle. By determining the plane in which the ball initially or soon thereafter traveled, the deviation of the ball from a straight shot may be determined. The distance that the ball would have traveled is derived from the speed with which the axle rotates.

In another embodiment, an apparatus for estimating the accuracy of a practice golf shot includes a ball attached to an axle slidable along its axis, an axial sensor for detecting axial motion of the axle, and circuitry coupled to the axial sensor for converting the detected axial motion of the axle into an estimated direction of the practice golf shot. The apparatus further includes a display coupled to the circuitry for displaying the estimated direction of the practice golf shot. The axial sensor may further include an optical sensor that has a slotted element coupled to the axle and a first optical sensor that detects motion of the slotted element. A second optical sensor may be used to detect the direction of the motion of the slotted element. Other embodiments utilize an axial sensor with a strain gauge oriented such that the strain gauge is actuated upon axial motion of the axle. The apparatus may also include a rotation sensor for detecting angular motion of the axle, whereby the circuitry further converts the detected angular motion of the axle into an estimated distance of the practice golf shot.

The invention further includes a method for estimating the accuracy of a practice golf shot including providing a ball attached to an axle, detecting axial motion of the axle with an axial sensor, and converting the detected axial motion of the axle into an estimated direction of the practice golf shot.

DETAILED DESCRIPTION OF A PREFERRED EMBODIMENT

Figure 1:
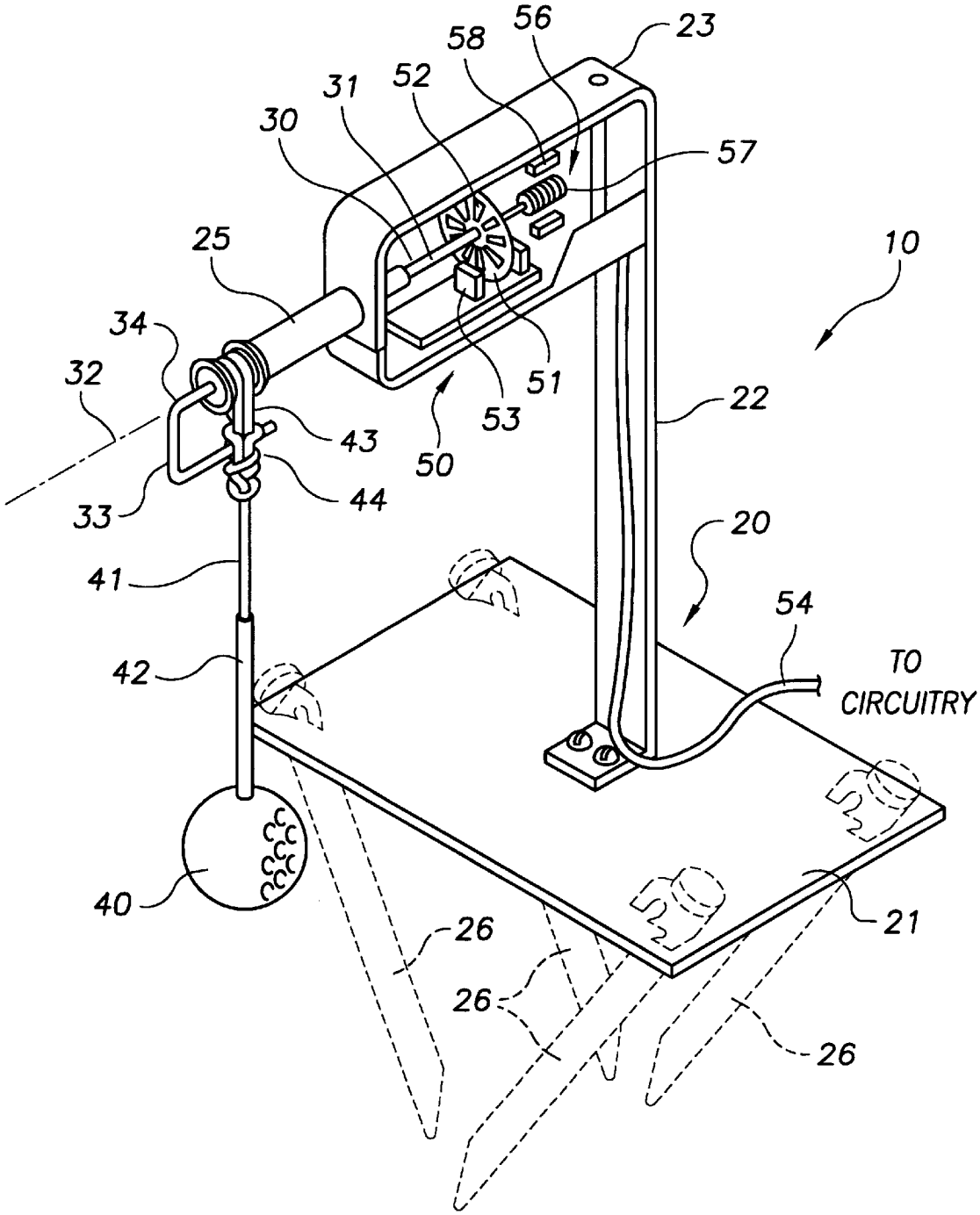
FIG. 1 is a perspective view of an apparatus for practicing a golf shot that provides an estimate of both the distance and the accuracy of the shot in accordance with the present invention.

As shown in FIG. 1, a golf practice shot apparatus is designated generally by reference numeral 10. In a preferred embodiment, the apparatus 10 is designed to be easily and compactly stored when not in use. The apparatus 10 includes a base 20, an axle 30, a golf ball 40, a sensor assembly 50, circuitry (not shown) and a display (not shown). Generally, the base 20 supports the axle 30, the golf ball 40 extending therefrom and the sensor assembly 50. When the golf ball 40 is struck by a practicing golfer (not shown) the golf ball imparts motion to the axle 30, and the motion of the axle is detected by the sensor assembly 50. The sensor assembly transmits the sensed motion to the circuitry and the circuitry estimates the total distance that the ball would have traveled and estimates whether the shot was straight or not, and, if the shot was not straight, estimates the deviation from a straight path. The circuitry transmits the estimated distance and the estimated accuracy to a display, and the display preferably displays the estimated distance in yards using a LCD readout and the estimated accuracy using an LED readout to indicate the direction and magnitude of deviation from a straight shot.

In greater detail, the base 20 supports the axle 30 and contains the sensor assembly 50. The base 20 may further include a base plate 21, a bracket 22 mounted upwards from the base plate 21 and a housing 23 extending off of the bracket 22. The housing 23 contains the sensor assembly 50. The housing may also include a supporting extension 25 that supports the axle 30 extending therethrough and the golf ball 40. The base 20 may be secured to a suitable surface by attaching the base plate 21 with stakes 26, or any other suitable means such as screws and the like, to the surface. Alternatively, the base plate could be sufficiently heavy and/or have a contact surface such that stakes 26 or the like are unnecessary. For example, the base plate 21 could be sufficiently large such that a golfer desiring to use the apparatus 10 could stand on the base plate itself thereby safely securing the base 20 relative to a suitable surface.

The axle 30 includes a first section 31 that is substantially coaxial with an axis 32 and mounted at least partially within the axle support 25 of the housing 23. The axle 30 also includes a second section 33 that is not coaxial with axis 32 at a proximal end 34 of the axle. As shown in FIG. 1, the second section 33 is in a "U-shape". Of course, those skilled in the art will quickly appreciate that the second section 33 may be any suitable shape that not coaxial to the axis 32. The axle 30 is free to rotate about the axis 32 and free to move at least some amount along the axis 32 as well. Preferably, the axle 30 is movable along the axis 32 at least 0.25 inches and more preferably at least 0.50 inches.

The golf ball 40 may be any simulated or real golf ball and is preferably a hard rubber or plastic. It is desirable to use a golf ball 40 that has the "feel" of a real golf ball when struck by a golf club (not shown). The golf ball 40 is connected to the proximal end 34 of the axle 30 by a tethering line 41. The tethering line 41 may include a stiffening sheath 42 to provide rigidity to the tethering line in order to more effectively transmit motion to the axle 30. The tethering line should be made of any strong material that can withstand the forces associated with striking and occasionally missing a golf ball. The tethering line may also include a loop 43 that preferably loops around the extending support 25 which may contain a groove for rotation thereabout by the loop 43.

As seen in FIG. 1, the tethering line 41 is connected to the second section 33 of the axis at 44 by a knot, clamp or any other suitable means. The tethering line 41 is connected to the axle 30 such that when the golf ball is struck and rotates about the axis 32, the tethering line 41 causes the axle 30 to rotate about the axis 32 along with it. The tethering line is further connected to the 30 axle such that motion of the golf ball 40 outside the plane orthogonal to the axis 32 is transmitted to the axle 30 and causes the axle to move along the axis 32. In other words, if the golf ball is struck squarely and straight (as is usually desirable in a golf shot) the ball will not move along the axis 32 and instead it will rotate about the axis 32 in a plane that is perpendicular thereto. If, however, the ball is not struck squarely, the ball will move outside this plane and impart some force and motion on the axle in a direction along the axis 32. Thus, the tethering line transmits the angular velocity of the golf ball to the axle and also transmits motion of the golf ball relative to the axis of the axle.

The sensor assembly 50 includes a rotation sensor 51 and an axial sensor 56. The rotation sensor 51 may be any device that detects the speed with which the axle rotates about axis 32. As seen in FIG. 1, the rotation sensor 51 may include a slotted disk 52 mounted to the axle 30 that cooperates with a conventional optical source and receiver unit (also knows as an optical sensor, photosensor or photomicrosensor) 53 mounted to the housing 23. Such a rotation sensor is available from Omron Electronics, Inc. of Schaumburg, Ill. (e.g., part EE-SX1041) or from Sharp Microelectronics of Camas, Wash. (e.g., part GP1A30R). As the slotted disk 52 rotates, it alternatingly blocks and passes light to the photosensor 53 creating electrical pulses which are conveyed by wire 54 to the circuitry to determine the angular velocity of the axle 30. The angular velocity of the axle 30 may then be determined from the number of electrical pulses generated in a given amount of time. See also U.S. Pat. No. 5,178,393 to Dennesen.

Figure 2:
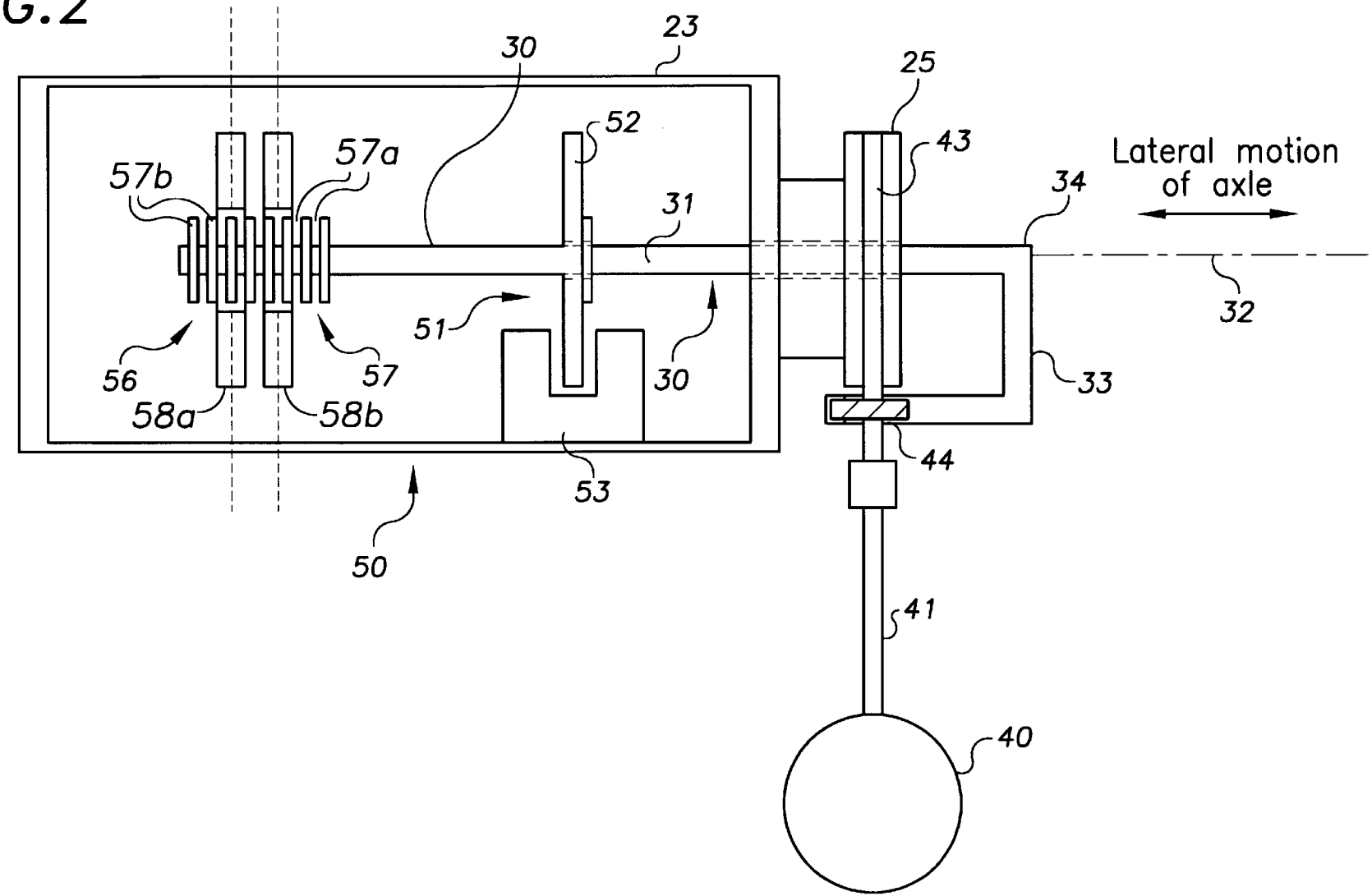
FIG. 2 is a schematic view of the apparatus of FIG. 1.

As depicted in FIG. 2, the slotted disk 52 is mounted to the first section 31 of the axle 30 such that the slotted disk rotates with the axle. To avoid interference with the photosensor 53 that might limit the movement of the axle 30 along axis 32, the slotted disk 52 is at least partially free to move along the axis 32. The axle 30 and the slotted disk 52 may be keyed (not shown) to compel the disk to rotate with the axle while also permitting axial movement of the disk along the axis 32. Other methods of limiting physical interference between the slotted disk 52 and the photosensor 53 include widening the photosensor and/or using other sensor configurations such as a reflective photosensor.

The axial sensor 56 may likewise comprise any device that detects the motion of the axle 30 along the axis 32. As seen in FIG. 1, and more clearly in FIG. 2, a preferred embodiment includes a slotted element 57 mounted to the axle 30 that cooperates with an photosensor 58. Such an axial sensor is available from Omron Electronics, Inc. (e.g., parts EE-SX670/470, EE-SH3M). Again, the motion of the axle 30 along the axis is determined by the electrical pulses generated by passing the slotted element 57 through the photosensor 58. The magnitude of motion and the speed of motion along the axis 32 may be determined from the electrical pulses over a period of time and conveyed to the circuitry by wire 54.

To determine which direction along the axis 32 the axle is moving (thereby indicating whether the practicing golfer hit the ball left or right), two photosensors **58*a*, 58*b* may be used as depicted in FIG. 2. The slotted element 57 has alternating slots 57*a* to let light pass through and sections of material 57*b* to block light from the optical switch (the light is typically supplied by a light emitting diode and the light is detected by a photo transistor in the photosensor and such devices are conventionally available). Preferably, the slots 57*a*** are evenly sized and spaced.

The two photosensors **58*a*, 58*b* are then mounted relative to each other such that the distance separating them results in two pulse signals from the photosensors that are out of phase with each other. Preferably the photosensors are some odd whole number multiple of the spacing of the slots 57*a* such that they are fully out of phase. With the photosensors 58*a* and 58*b* out-of-phase with each other, the direction of motion of the axle can be determined by which photosensor signal is leading the other. The starting point for observing the photosensor signals (in order to determine which signal is leading) may be defined as when the rotation sensor 51** first detects angular rotation of the axle. Such direction of motion detection could also be accomplished using a single photosensor that has multiple channels and a slotted element adapted for use with same.

Thus, the magnitude of the movement of the axle along the axis 32 is determined by counting the slots that pass by the photosensor 58. And the direction of movement of the axle is determinable by comparison of the signals from the photosensors 58*a*, 58*b*.

In an alternative embodiment (not shown), the sensor could determine whether the axle moves left or right by positioning each photosensor proximal to an opposite end of the slotted element. In this embodiment, when one of the photosensors reaches an end of the slotted element, the signal produced by that photosensor will no longer have the same period as the signal produced by the other. Therefore, the circuitry can determine the direction of motion of the axle based upon whichever photosensor signal fails to follow the established pattern or have the same period.

Figure 3:
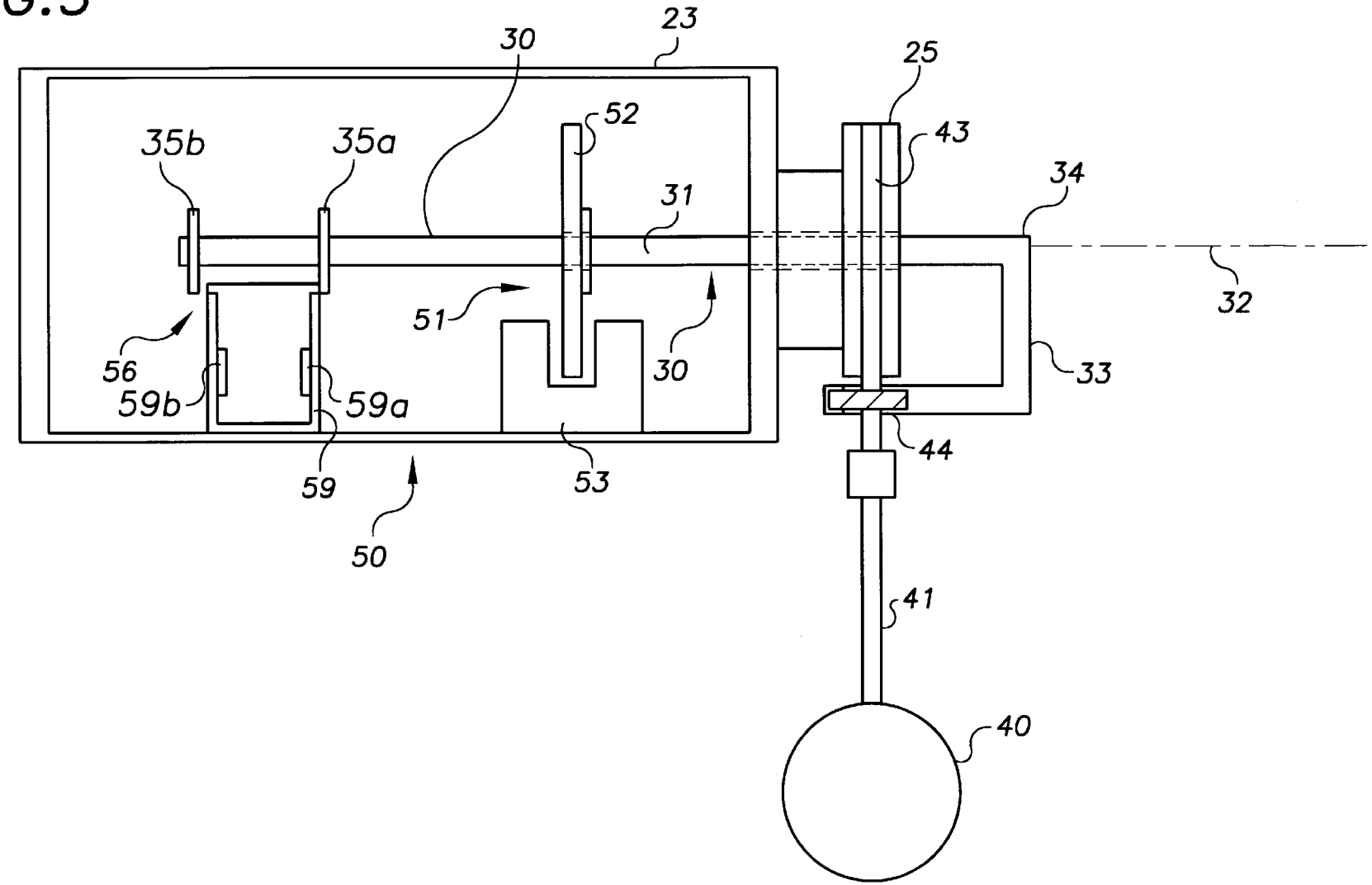
FIG. 3 is a schematic view of an alternative embodiment of an apparatus in accordance with the present invention.
Figure 4A:
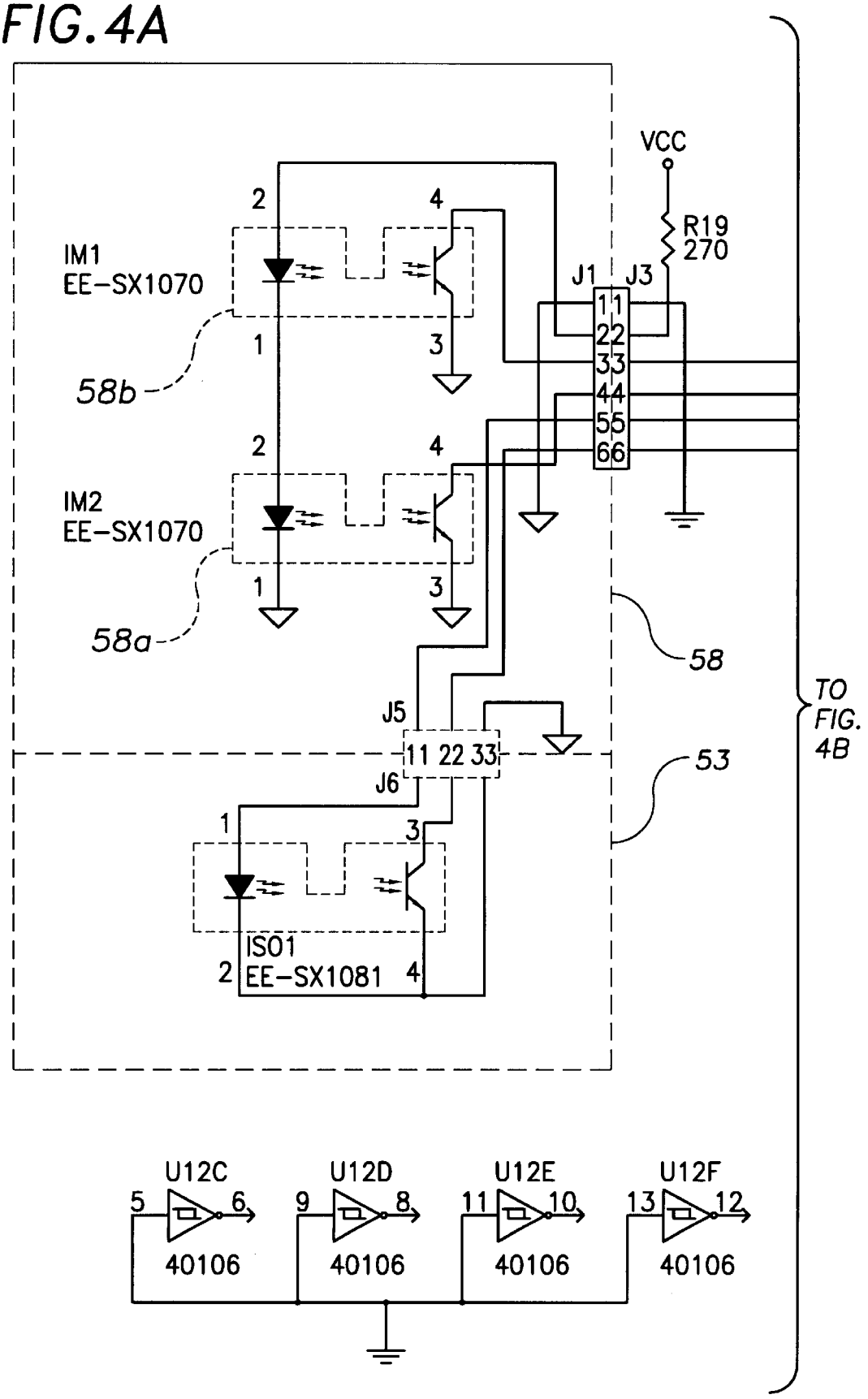
FIGS. 4 and 5 are a circuit diagram of a circuit for use in accordance with the present invention.
Figure 4B:
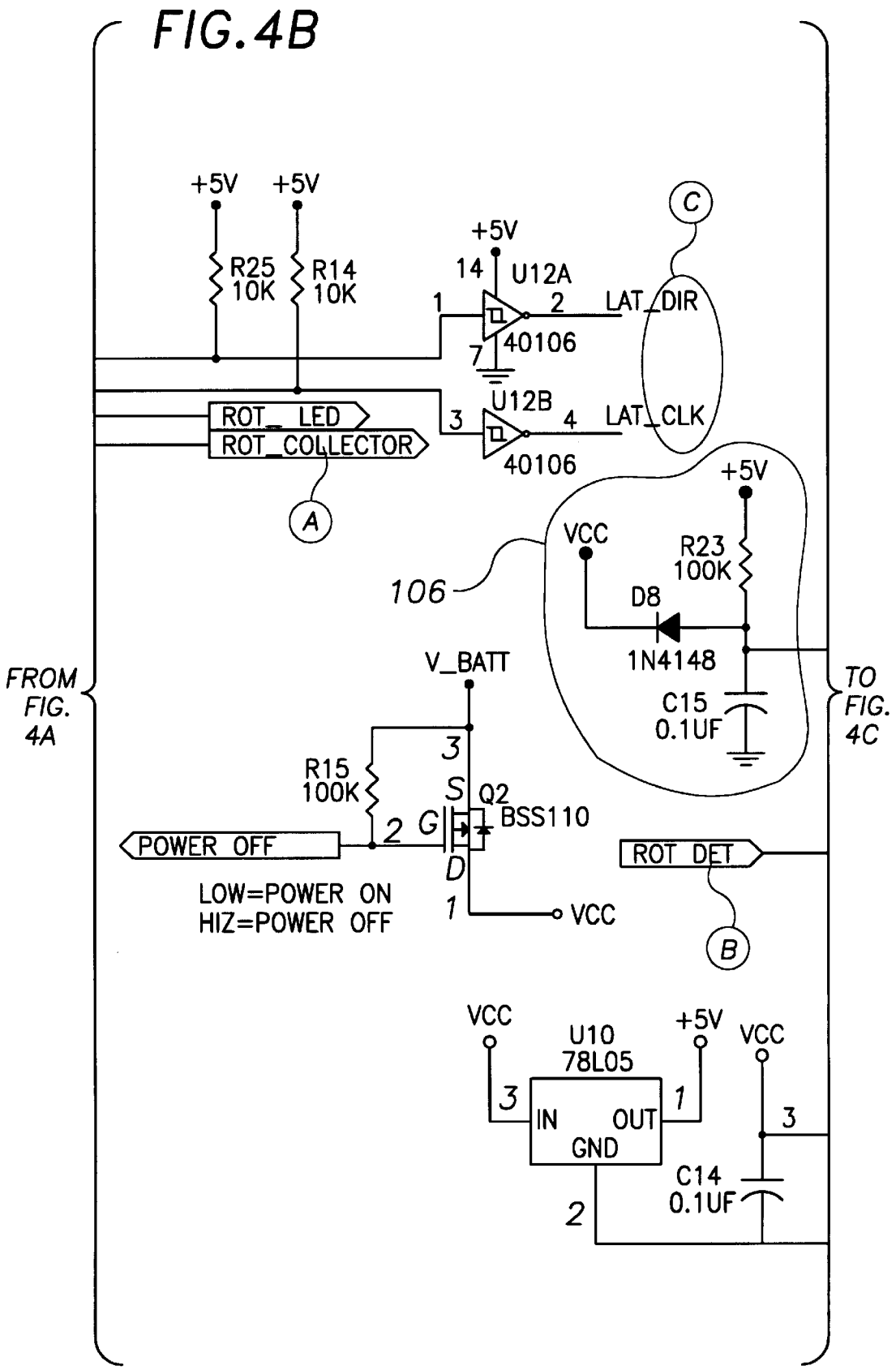
Figure 4C:
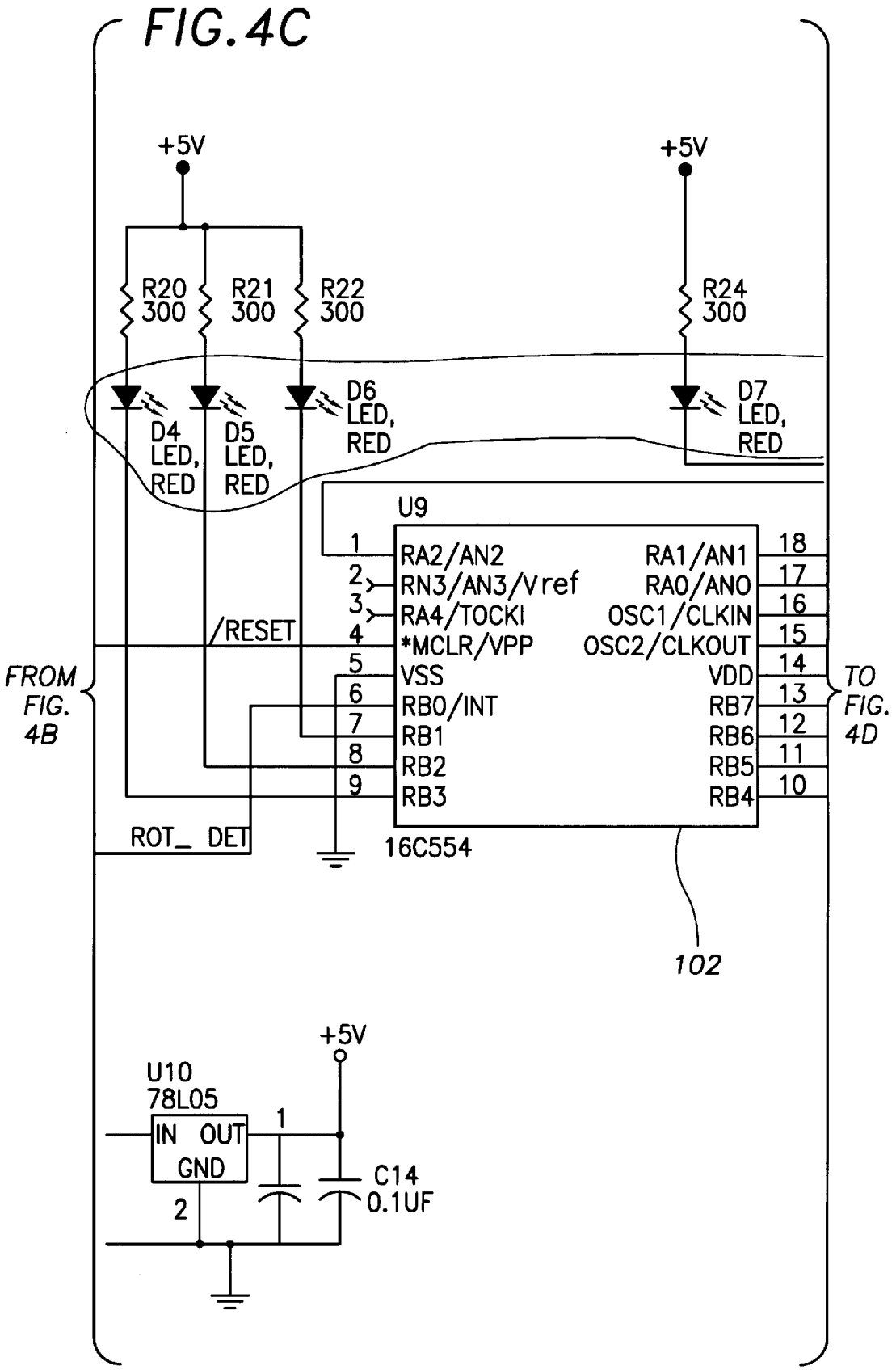
Figure 4D:
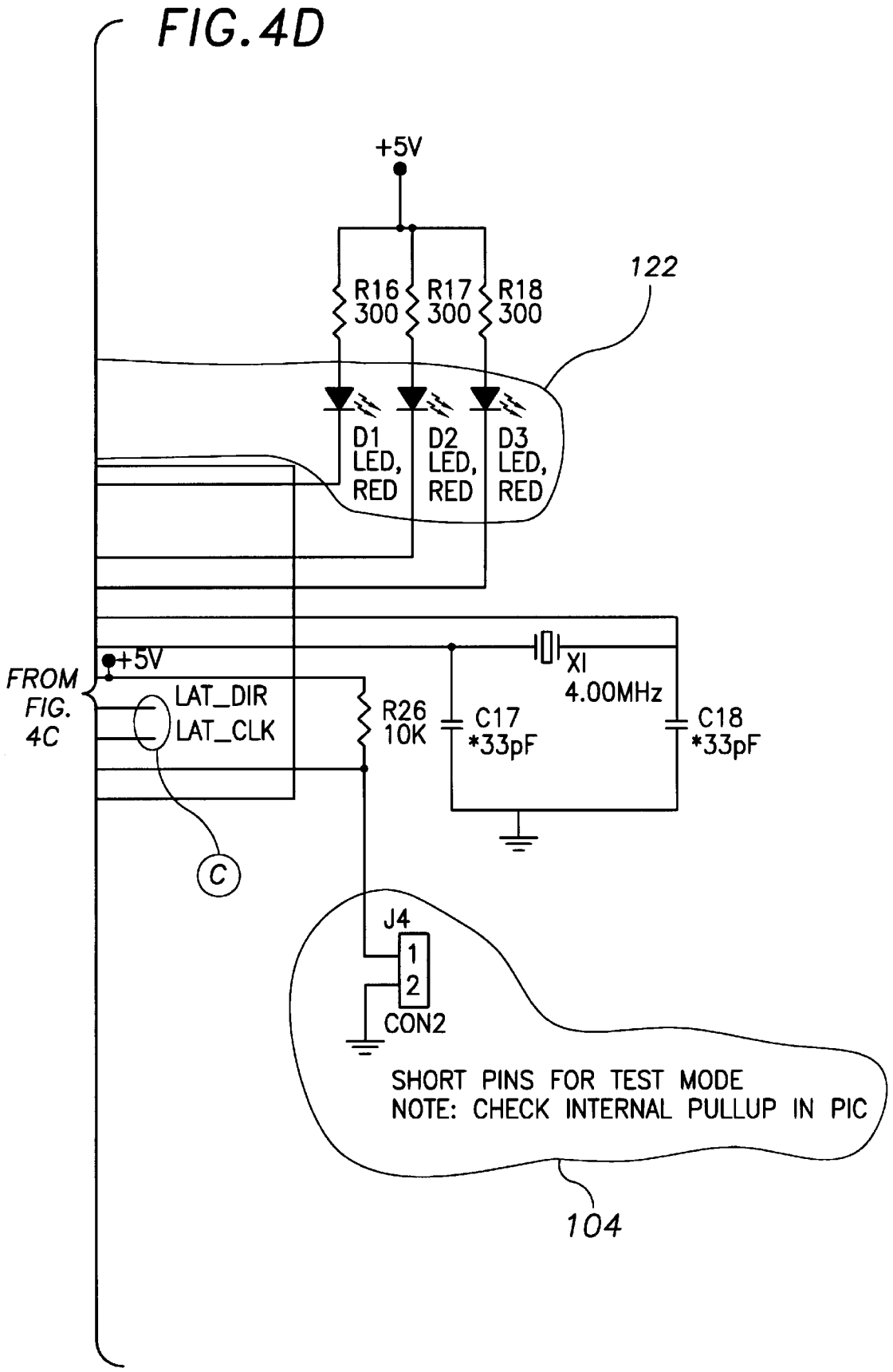
Figure 5A:
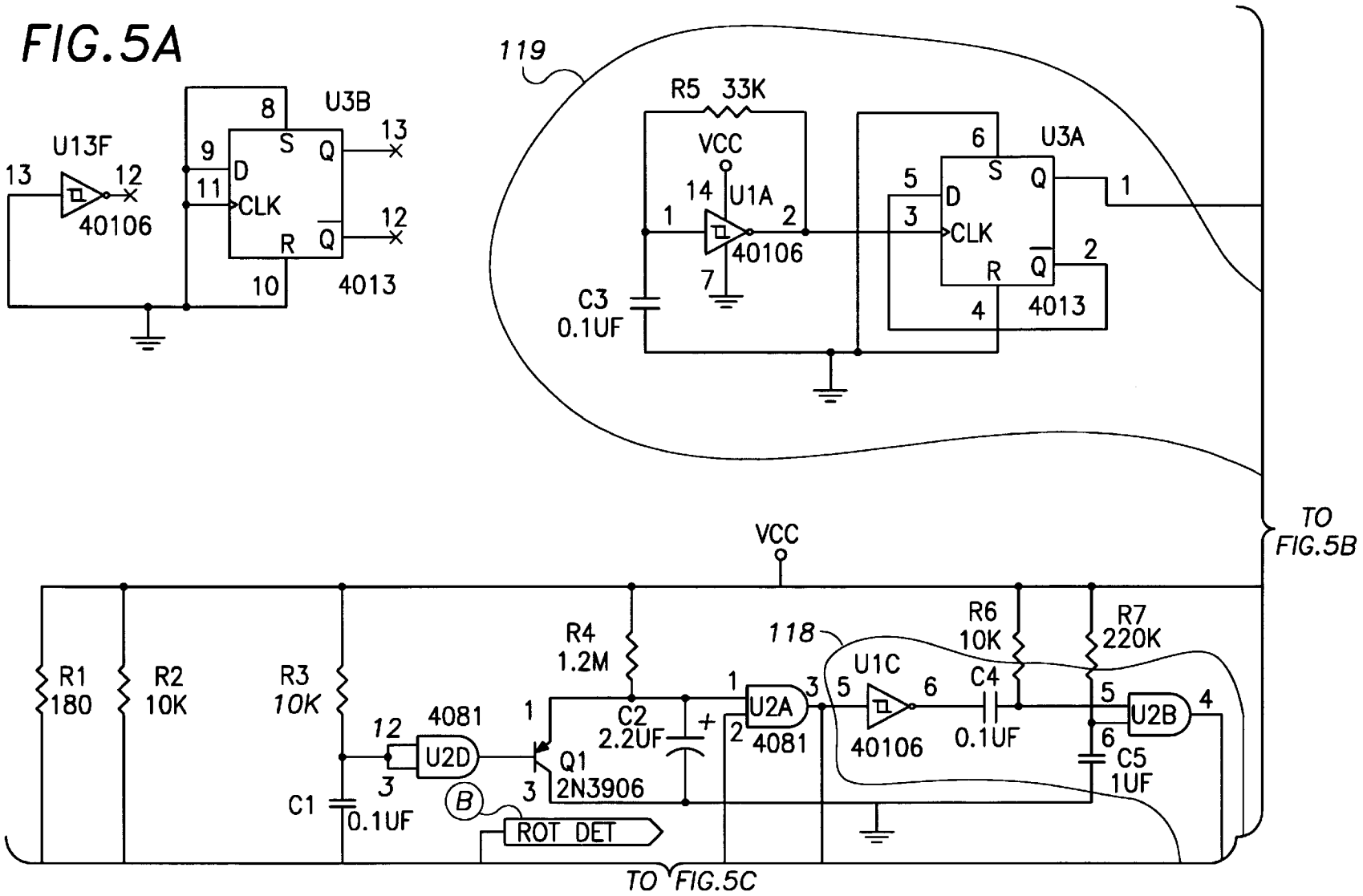
Figure 5B:
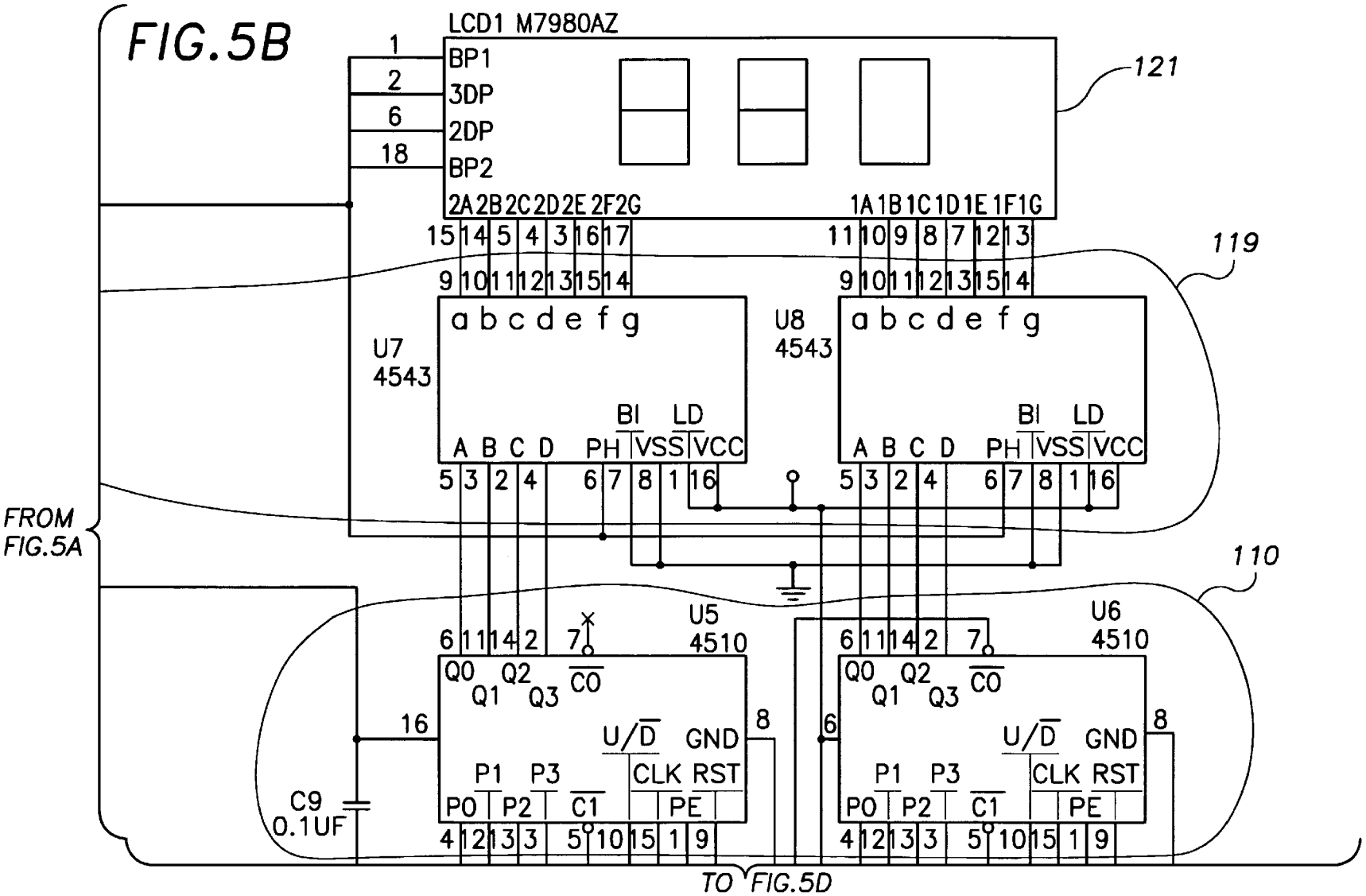
Figure 5C:
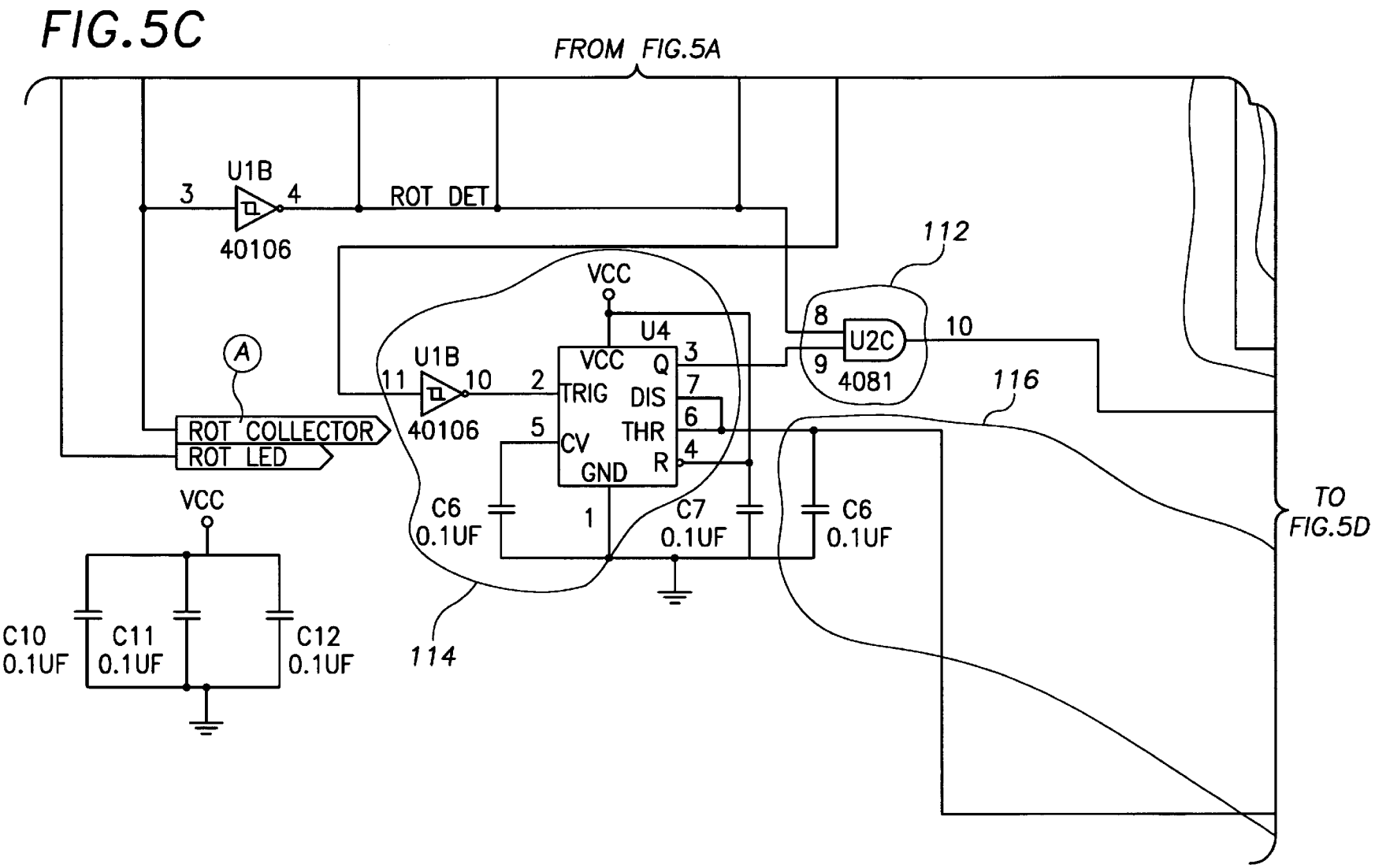
Figure 5D:
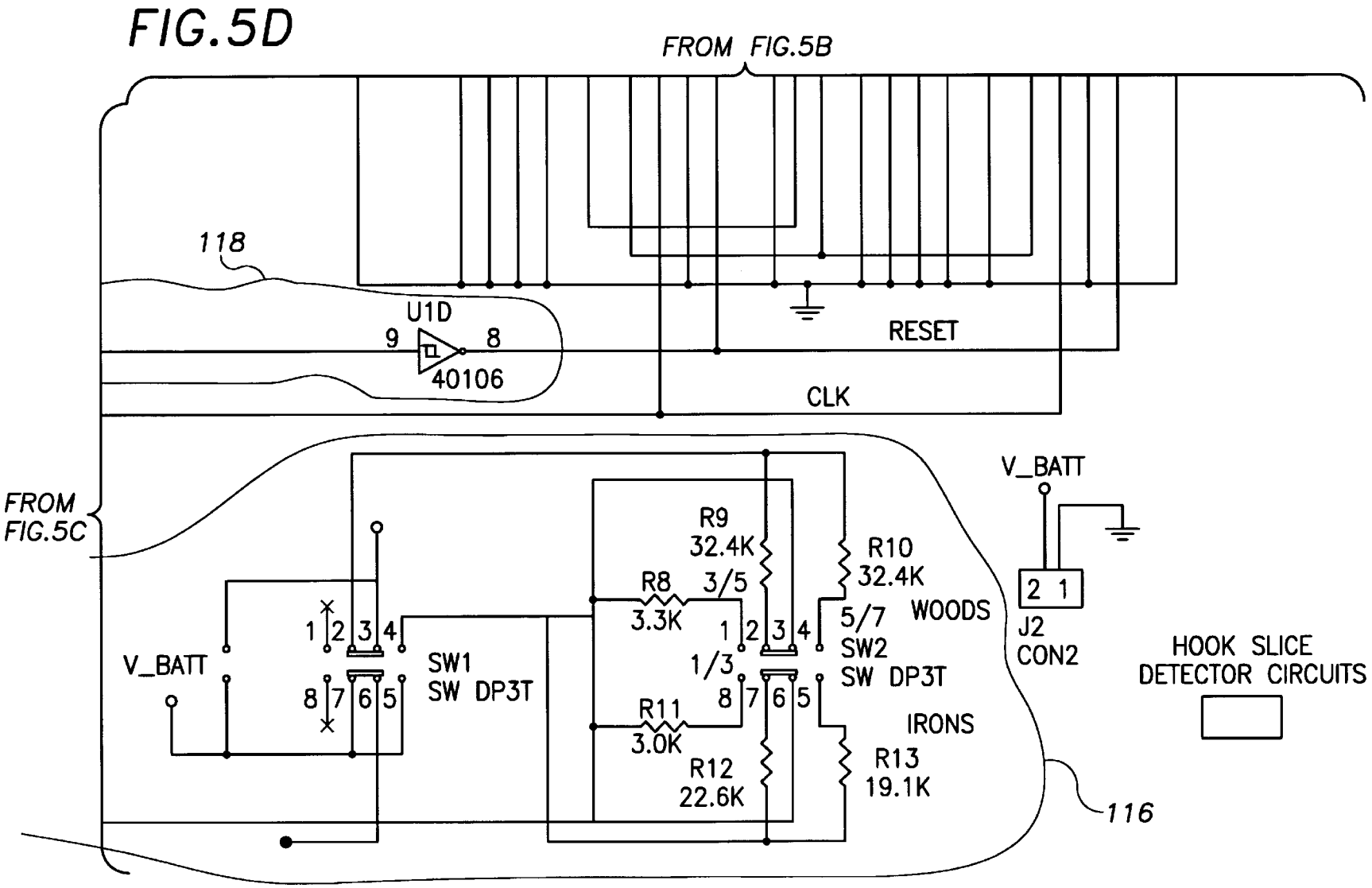

Another embodiment for detecting motion of the axle 30 along the axis 32 is shown in FIG. 3. This particular embodiment utilizes a mechanical (rather than an optical) motion sensor 59. The motion sensor 59 may include strain gauges 59*a*, 59*b* and the axle 30 further includes collars 35*a*, 35*b*. When the axle 30 moves to the left (in FIG. 3), collar 35*a* will deform strain gauge 59*a* thereby providing a measure of the magnitude of deflection of the axle 30. When the axle moves to the right, collar 35*b* will likewise deform strain gauge 59*b*. The direction of movement can easily be ascertained by determining which gauge 59*a*, 59*b* was deformed. Like the other sensors described above, the strain gauges 59*a*, 59*b* are connected to the circuitry by a wire or cable (not shown).

As mentioned above, the rotation sensor 51 and the axial sensor 56 detect motion of the axle. The sensors 51, 56 need not be separate devices. Furthermore, one or more motion sensing devices other than an optical sensor or strain gauge may be used, including but not limited to a contact resistance sensor and a reflective sensor. The slotted disk and slotted element need not have slots in the form of holes, but instead could have slots that are merely reflective surfaces, painted stripes or any other feature that can be sensed by a machine. The sensors could also comprise one or more mechanical gears that allow and detect the motion described above.

Turning now to FIGS. 4 and 5, the circuitry converts the signals received from the rotation sensor 51 and the axial sensor 56 into estimations of distance and deviation from a straight path. Generally, the circuitry includes conventional timing and summing circuits to derive from the number of pulses from the photosensors the distance and the magnitude of the left or right deviation (or hook or slice; or push or pull) of the practiced golf shot. The circuitry further determines from the two photosensors the direction (left or right), if any, of the deviation. The circuitry then conveys the estimated distance and magnitude of deviation and the direction of deviation (left, right or straight) to the display.

In greater detail, the circuity in FIGS. 4 and 5 include the photosensors 53, 58*a* and 58*b*. The data in the form of pulses from photosensors 58*a*, 58*b* are indicated at flag C and are input into microprocessor 102 for analysis. The microprocessor 102 includes conventional programing to analyze and count the photosensor data for magnitude and direction of motion of the axle. Coupled to the microprocessor 102 is a solid state switch 104 for powering down the microprocessor and the circuitry upon inactivity.

The data pulses from the photosensor 53 are indicated at flag A and are input to an accumulator 110 via a NAND gate 112. The NAND gate is also connected to a triggering device 114 that creates a window in which data from the photosensor is passed to the accumulator 110. The window created by triggering device 114 is initiated upon the first pulse received from photosensor 53. The width (or time) of the window may be preselected at adjustment switch 116. As depicted in FIG. 5, the adjustment switch 116 has an on/off position and six other settings depending on the club that the practicing golfer will be using. In other words, if the practicing golfer is going to hit a driver, the driver setting on the adjustment switch 116 will cause triggering device 114 to create a wider window thus providing a longer pulse input from photosensor 53. On the other hand, if the 5-iron setting is chosen, the window will be more narrow thereby limiting the pulse input to the accumulator 110 from photosensor 53.

A reset pulse is provided via circuitry 118 to the accumulator 110 to clear the registers before accumulation begins. The estimated distance traveled by the ball struck by the practicing golfer is directly related to the summed pulses from the photosensor 53 in the accumulator 110.

A signal from photosensor 53 at flag B is input to the microprocessor 102 upon stimulation of photosensor 53. In this manner, the microprocessor 102 knows when to "look" and initialize itself to begin an analysis of the pulses from the photosensors 58*a*, 58*b* for magnitude and direction of motion information pertaining to the axle. The magnitude of motion is derived from the number of pulses received from photosensors 58*a*, 58*b*. The direction of motion is derived from the phase relationship of the two photosensors 58*a*, 58*b*. The microprocessor includes logic that stops counting the number of pulses upon a change in direction of motion of the axle.

The display can display the distance and deviation in any of a number of desirable formats. Depicted in FIG. 5 is an LCD 121 driven by display driver 119 which in turn receives a signal from the accumulator 110. The LCD 121 displays the estimated distance of the practiced shot (the signal from the accumulator 110) as a yardage. In FIG. 4, the magnitude and direction of the deviation of the practiced shot is displayed using seven LEDs 122. One LED corresponds to straight, three LEDs correspond to three different magnitudes to the right, and three LEDs corresponding to three different magnitudes to the left. The LEDs are driven by microprocessor 102.

Figure 6:
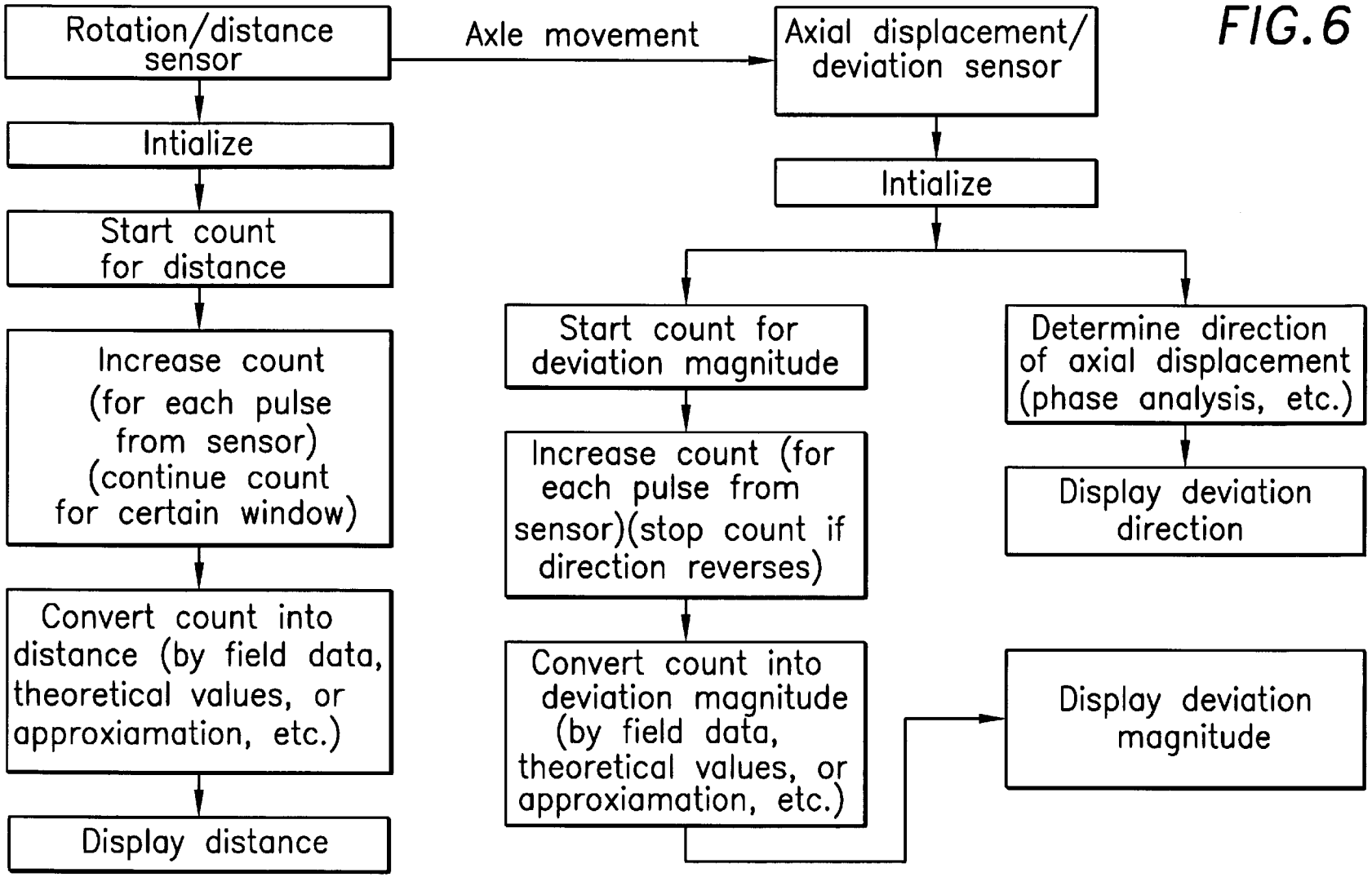
FIG. 6 is a block diagram of a method in accordance with the present invention.

Turning now to FIG. 6, a functional block diagram of the present invention is shown. The diagram depicts the steps of initializing the rotation sensor, counting pulses detected by the rotation sensor, continuing the pulse count for a certain window (of time or other indicia), converting the pulse count from the rotation sensor into a distance and displaying the distance. The diagram further depicts the steps of initializing the axial sensor, determining the direction of axial movement of the axle, displaying such direction, counting pulses detected by the axial sensor, continuing the pulse count for a certain window (of time, upon reversal of direction or other indicia) and converting the pulse count from the axial sensor into a magnitude of deviation.

While a preferred embodiment has been shown and described, it will be understood that it is not intended to limit the disclosure, but rather it is intended to cover all modifications and alternate methods falling within the spirit and the scope of the invention as defined in the appended claims. For example, a conversion factor used by the circuitry to determine the estimated distance of travel of the golf ball may be made to be adjustable depending on the club used by the golfer. In other words, if the golfer is using a driver, the conversion factor should be higher than if the golfer is using a nine-iron. Those familiar with the sport of golf know that a golf ball struck with the same force by a driver and by a nine-iron will travel vastly different distances. The device would simply include a switch whereby the practicing golfer can adjust the switch to "tell" the device which club is being used to strike the ball and the device can use a different conversion factor to compensate for the club being used based upon the setting of the switch. Alternatively, as described above, the conversion factor could relate to the time frame in which the pulses from the sensors are summed. Thus, if the practicing golfer selects a switch for a driver, the apparatus would sum the pulses from the sensors for a longer period of time (thus providing a longer distance estimate) than when the golfer selects, for example, the 9-iron switch.

Furthermore, it should be readily appreciated that other applications for estimation of motion based upon sensing movement of a rotating axle can be implemented. For example, instead of using a LCD and LED display, the circuitry could connect to a personal computer or video game deck for use with a virtual/simulated golf game. Similarly, other sports could be simulated like baseball, tennis or hockey. Each of these applications and others would make use of an estimate of the projected motion of an object moving in a plane and constrained to rotate about an axis, where it is desirable to estimate the angle (initial or otherwise) of that plane.

We claim:

1. An apparatus for estimating the accuracy of a practice golf shot, comprising:

a ball attached to an axle slidable along its axis;

an axial sensor for detecting axial motion of the axle; and circuitry coupled to the axial sensor for converting the detected axial motion of the axle into an estimated direction of the practice golf shot.

2. The apparatus of claim 1 further comprising a display coupled to the circuitry for displaying the estimated direction of the practice golf shot.

3. The apparatus of claim 2 wherein the display includes an LED readout.

4. The apparatus of claim 1 wherein the axial sensor includes a slotted element coupled to the axle and a first optical sensor that detects motion of the slotted element.

5. The apparatus of claim 4 wherein the axial sensor includes a second optical sensor to detect the direction of the motion of the slotted element.

6. The apparatus of claim 5 wherein the second optical sensor and the first optical sensor are oriented such that they are at least slightly out of phase with respect to axial motion of the slotted element.

7. The apparatus of claim 6 wherein the second optical sensor is separated from the first optical sensor by an odd, whole number multiple of the width of a slot in the slotted element.

8. The apparatus of claim 4 wherein the first optical sensor includes at least two channels and a slotted element adapted for use with the two channels.

9. The apparatus of claim 4 wherein the optical sensor includes at least one of a photosensor and a reflective sensor.

10. The apparatus of claim 1 wherein the axial sensor includes a strain gauge oriented such that the strain gauge is actuated upon axial motion of the axle.

11. The apparatus of claim 10 wherein the axle includes a collar for actuating the strain gauge.

12. The apparatus of claim 11 wherein the axial sensor includes a second strain gauge oriented such the second strain gauge is actuated upon axial motion of the axle in a direction opposite to that which actuates the first strain gauge.

13. The apparatus of claim 1 wherein the circuitry includes subcircuitry that sums pulses received from the axial sensor during a window and converts the summed pulses into the estimated direction of the practice golf shot.

14. The apparatus of claim 13 wherein the window is adjustable based upon a type of golf club used to strike the golf ball.

15. The apparatus of claim 1 wherein the axle is rotatable about its axis and further comprising a rotation sensor for detecting angular motion of the axle.

16. The apparatus of claim 15 wherein the circuitry is further coupled to the rotation sensor for converting the detected angular motion of the axle into an estimated distance of the practice golf shot.

17. The apparatus of claim 16 wherein the circuitry includes subcircuitry that sums pulses received from the rotation sensor during a window and converts the summed pulses into the estimated distance of the practice golf shot based upon a conversion factor.

18. The apparatus of claim 17 wherein the conversion factor is adjustable based upon a type of golf club used to strike the ball.

19. The apparatus of claim 16 wherein the circuitry converts the detected axial and angular motion of the axle into an estimated distance and an estimated deviation of the practice golf shot.

20. The apparatus of claim 19 wherein the display further displays the estimated distance of deviation of the practice golf shot.

21. The apparatus of claim 16 wherein the display further displays the estimated distance of the practice golf shot.

22. The apparatus of claim 15 wherein the rotation sensor includes a slotted disk that rotates with the axle and an optical sensor that detects angular motion of the slotted disk.

23. The apparatus of claim 1 wherein the golf ball is attached to the axle with a tethering line of a predetermined length.

24. The apparatus of claim 21 wherein the tethering line includes a stiffening sheath to provide rigidity to the tethering line.

25. An apparatus for estimating a distance and direction of travel of a struck object comprising:

a base;

an axle rotatably and slidably mounted to the base, the struck object being attached to the axle;

a sensor for detecting angular motion and axial motion of the axle; and circuitry coupled to the sensor for estimating the distance and the direction of travel of the struck object based upon the detected angular motion and axial motion of the axle, respectively.

26. The apparatus of claim 25 further comprising a computer coupled to the circuitry for utilizing the estimated distance and the estimated direction of travel of the struck object.

27. The apparatus of claim 25 wherein the sensor includes a first sensor for measuring angular motion of the axle and a second sensor for measuring axial motion of the axle.

28. The apparatus of claim 27 wherein the first sensor and the second sensor include at least one of (i) a slotted element coupled to the axle and a optical sensor that detects movement of the slotted element, (ii) a strain gauge actuated by movement of the axle, (iii) a contact resistance sensor coupled to the axle and (iv) a mechanical gear coupled to the axle.

29. A method for estimating the deviation of a practice golf shot, comprising the steps of:

providing a ball attached to an axle, the axle being slidable along an axis;

detecting axial motion of the axle with an axial sensor; and converting the detected axial motion of the axle into the estimated deviation of the practice golf shot.

30. The method of claim 29 further comprising the step of displaying the estimated deviation of the practice golf shot on a display coupled to the circuitry.

31. The method of claim 29 wherein the axial sensor includes at least one of an optical sensor, a contact resistance sensor, a strain gauge and a mechanical gear.

32. The method of claim 29 further comprising the steps of providing a slotted element attached to the axle; and orienting a first optical sensor and a second optical sensor such that they are at least slightly out of phase with respect to motion of the slotted element along the axis.

33. The method of claim 32 wherein the conversion step includes the step of determining the direction of the axial motion of the axle based upon the phase relationship of the first and second optical sensors.

34. The method of claim 29 wherein the conversion step includes the step of determining the magnitude of the axial motion of the axle by summing impulses from the sensor.

35. The method of claim 29 further comprising the steps of providing a first strain gauge; and orienting the first strain gauge with respect to the axle such that axial motion of the axle actuates the first strain gauge.

36. The method of claim 35 further comprising the steps of providing a second strain gauge; and orienting the second strain gauge with respect to the axle such that axial motion of the axle in a direction opposite to that which actuates the first strain gauge, actuates the second strain gauge.

37. The method of claim 36 wherein the conversion step includes the step of determining the direction of the axial motion of the axle based upon which strain gauge is actuated.

38. The method of claim 29 wherein the axle is rotatable about its axis and further comprising the step of providing a rotation sensor for detecting angular motion of the axle.

39. The method of claim 38 further comprising the step of transforming the detected angular motion of the axle into an estimated distance of the practice golf shot.

40. The method of claim 39 wherein the transformation step includes the step of summing pulses received from the rotation sensor.

41. The method of claim 39 further comprising the step of displaying the estimated distance of the practice golf shot on the display.

* * * * *